US010060231B2

(12) United States Patent
Fisher et al.

(10) Patent No.: US 10,060,231 B2
(45) Date of Patent: Aug. 28, 2018

(54) GRAVEL PACK SYSTEM WITH SLURRY EXIT PORT IN COUPLING AND METHOD OF GRAVEL PACKING

(71) Applicants: Britain A. Fisher, Houston, TX (US); Elmer Peterson, Porter, TX (US)

(72) Inventors: Britain A. Fisher, Houston, TX (US); Elmer Peterson, Porter, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 171 days.

(21) Appl. No.: 15/186,748

(22) Filed: Jun. 20, 2016

(65) Prior Publication Data

US 2017/0362918 A1 Dec. 21, 2017

(51) Int. Cl.
*E21B 43/08* (2006.01)
*E21B 43/04* (2006.01)

(52) U.S. Cl.
CPC ..... *E21B 43/045* (2013.01); *E21B 43/086* (2013.01)

(58) Field of Classification Search
CPC ..... E21B 43/08; E21B 43/04; E21B 43/045
See application file for complete search history.

(56) References Cited

U.S. PATENT DOCUMENTS 5,082,052 A 1/1992 Jones et al.
5,113,935 A * 5/1992 Jones ..... E21B 43/08 166/278
5,390,966 A 2/1995 Cox et al.
5,842,516 A 12/1998 Jones
5,868,200 A * 2/1999 Bryant ..... E21B 43/04 166/242.3
6,409,219 B1 6/2002 Broome et al.
6,516,881 B2 * 2/2003 Hailey, Jr. ..... E21B 43/045 166/227
6,749,023 B2 * 6/2004 Nguyen ..... E21B 43/045 166/236
7,431,085 B2 10/2008 Coronado et al.
7,828,056 B2 * 11/2010 Dybevik ..... E21B 43/08 166/236
8,783,348 B2 7/2014 Edwards et al.
2017/0138158 A1 * 5/2017 Bourgneuf ..... E21B 43/04

OTHER PUBLICATIONS

"Direct Pak Ultra Screen"; Technical Unit—Screen Systems Conventional Screens; Baker Hughes, 2008, 10 Pages.

* cited by examiner

*Primary Examiner* — Kenneth L Thompson
(74) *Attorney, Agent, or Firm* — Cantor Colburn LLP

(57) ABSTRACT

A gravel pack system includes slurry transport hardware including a first slurry transport pathway, a coupling configured to couple the first slurry transport pathway to a radially interiorly arranged screen assembly, and a first exit port in the coupler. The first exit port is fluidically connected to the first slurry transport pathway, and the first exit port is arranged to re-direct at least a portion of slurry passing longitudinally through the first slurry transport pathway in a radially outward direction.

18 Claims, 8 Drawing Sheets

GRAVEL PACK SYSTEM WITH SLURRY EXIT PORT IN COUPLING AND METHOD OF GRAVEL PACKING

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. Downhole screens are frequently used to prevent solids from being produced from the formation. These screens are provided as tubular sections referred to as joints. Each screen joint is connectable to an adjacent screen joint, typically using a threaded connection. Gravel slurry is delivered to the annular space around the screens in the well bore with the object being to fill up the annular space with sand or other materials generally referred to as gravel. Gravel packing assembly pumps gravel slurry down tubing and the slurry exits the tubing to allow the slurry to flow into an annulus formed between a screen and the well casing or open hole. The liquid in the slurry flows into the formation of the well and/or the openings in the screen, which are sized to prevent the gravel from entering the screen. The gravel collects around the screen to form the gravel pack. The gravel allows flow of produced fluids there through and into the screen while blocking the flow of particulates produced with the formation fluids.

Many times the delivered gravel can bridge, which results in bare spots around the screens and an ineffective gravel packing operation. Various types of systems have been developed in the past to address the inefficiency of the gravel delivery around an annular space in a screen downhole with respect to bridging. When bridges caused by obstructions are created in the annulus, secondary flow path tubes, also called bypass tubes, transport tubes, shunt tubes, and alternate flow paths, which are in fluid communication with the gravel slurry, allow the slurry to flow through the tubes and out into the annulus through openings in the tubes downstream of the bridge. Thus, the annulus past the bridge can be packed with the gravel by employing the tubes. Where no annular obstruction exists, the secondary flow path tube is naturally bypassed for the easier flowing annulus.

The art would be receptive to improvements in gravel packing systems and methods.

BRIEF DESCRIPTION

A gravel pack system includes slurry transport hardware including a first slurry transport pathway, a coupling configured to couple the first slurry transport pathway to a radially interiorly arranged screen assembly, and a first exit port in the coupler. The first exit port is fluidically connected to the first slurry transport pathway, and the first exit port is arranged to re-direct at least a portion of slurry passing longitudinally through the first slurry transport pathway in a radially outward direction.

A method of gravel packing an annulus between a gravel pack system and an outer tubular includes: coupling a slurry transport tube of the gravel pack system to a connection area of a screen assembly with a coupling, the connection area including a connection between adjacent screen joints, the coupling including at least one exit port fluidically connected to the slurry transport tube; and, directing slurry into the annulus when a bridge is not formed in the annulus, and, if slurry passage is blocked by a sand bridge, bypassing the sand bridge using the slurry transport tube. At least a portion of the slurry flowing longitudinally through the slurry transport tube is radially directed into the annulus through the at least one exit port in the coupling.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
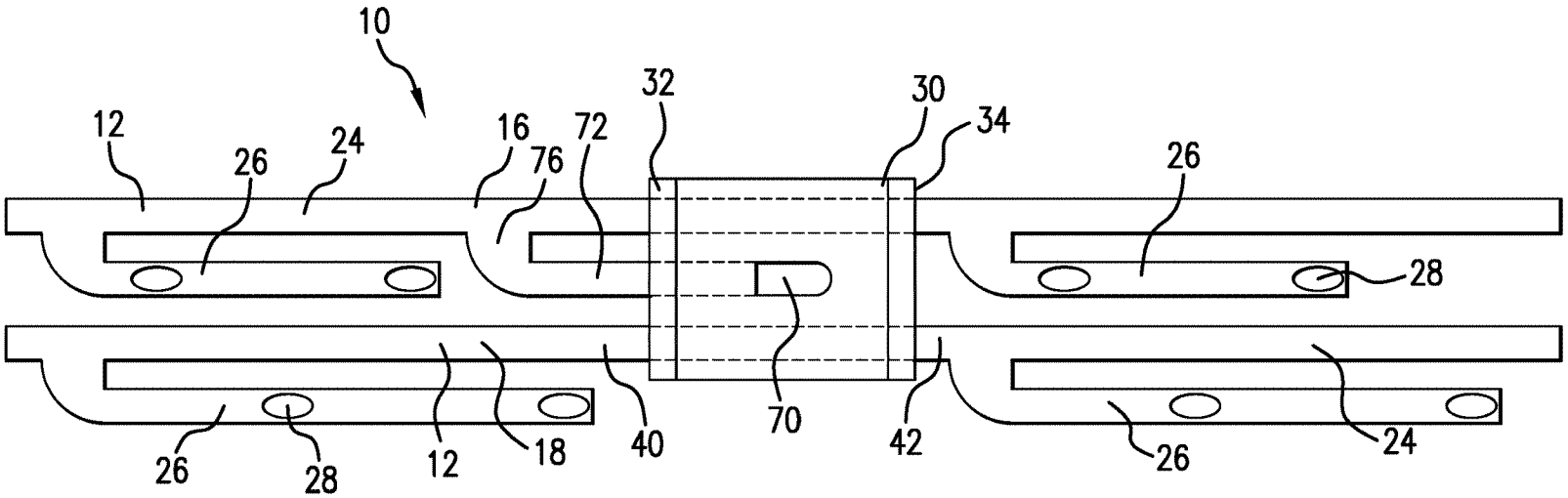
FIG. 1 depicts a schematic view of one embodiment of a portion of slurry transport hardware for a gravel pack system.
Figure 2:
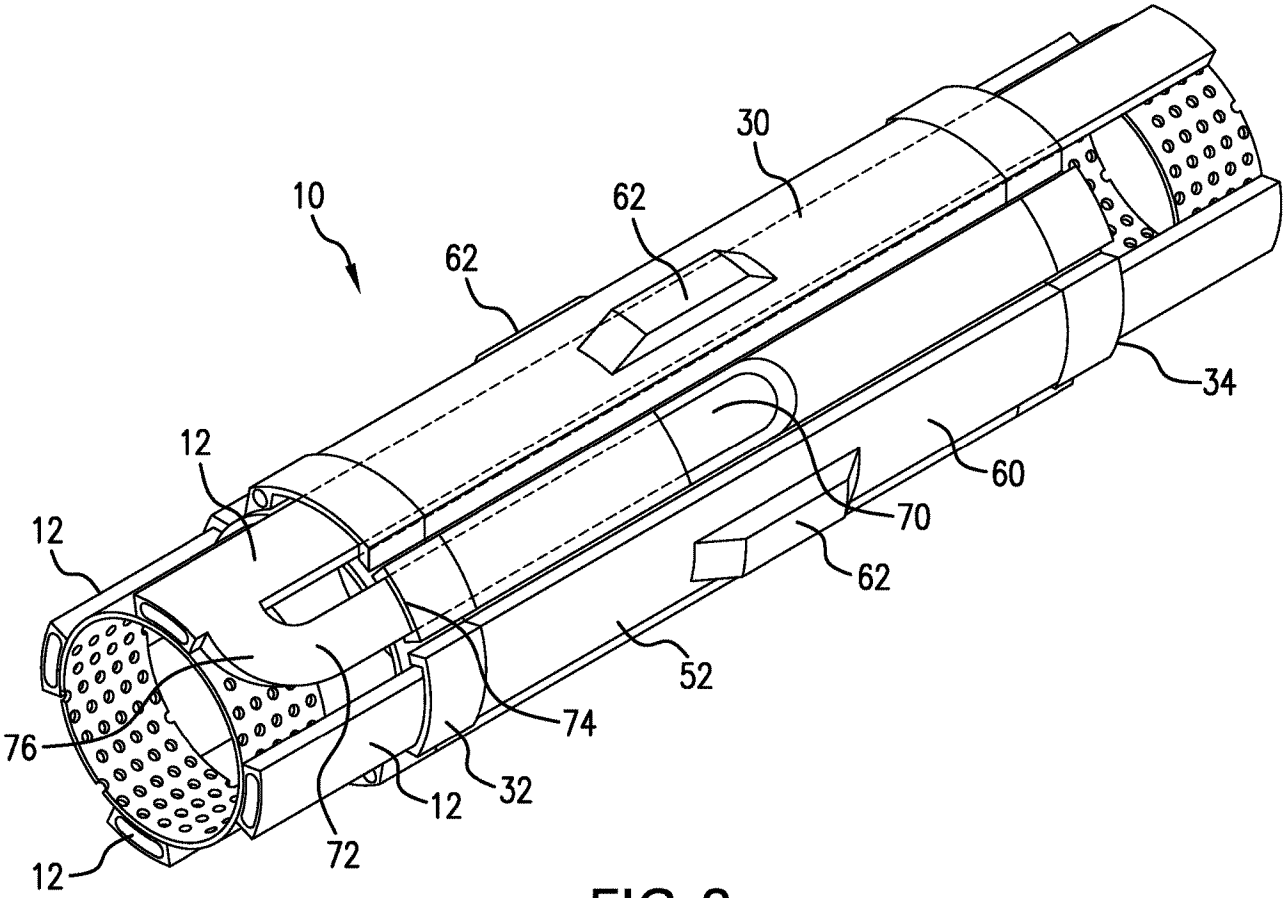
FIG. 2 depicts a perspective view of one embodiment of the portion of slurry transport hardware for a gravel pack system.
Figure 11:
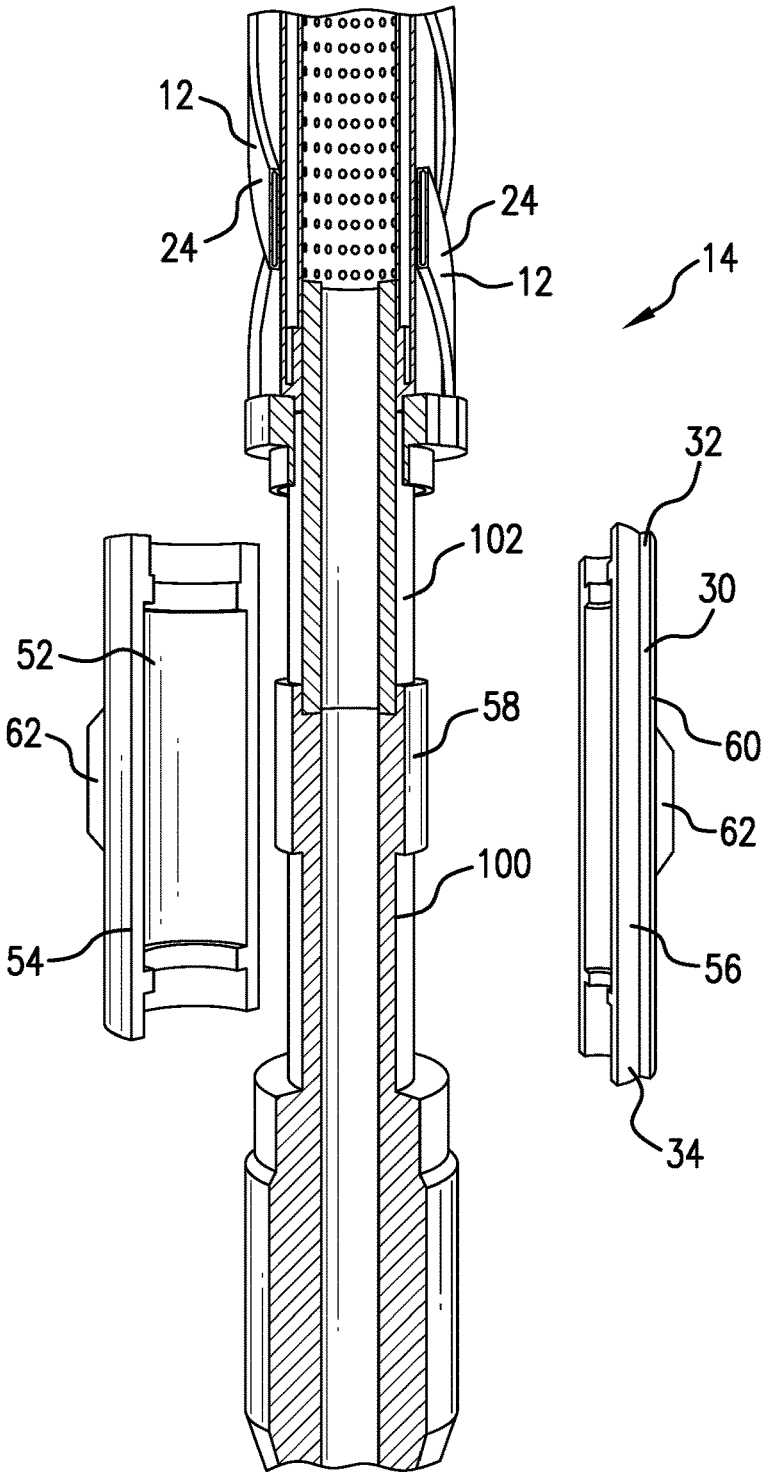
FIG. 11 depicts a partially exploded perspective view of a portion of one embodiment of a gravel pack system.
Figure 12:
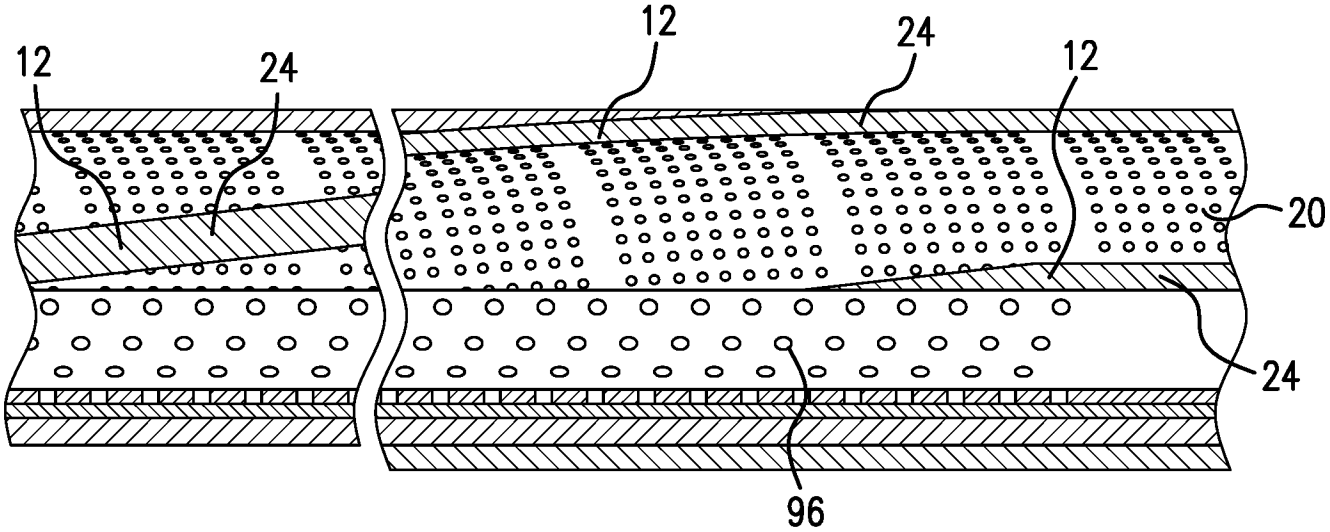
FIG. 12 depicts a cut-away view of a portion of one embodiment of a gravel pack system; and, FIG. 13 depicts a schematic view of one embodiment of a gravel pack system within a borehole.

With reference to FIGS. 1 and 2, one embodiment of portions of slurry transport hardware 10 having slurry transport pathways 12 for a gravel pack system 14 (FIGS. 11 and 13) is shown. The slurry transport pathways 12 provide an additional slurry transportation path should annular bridging occur during a gravel pack operation. FIG. 1 depicts first and second slurry transport pathways 16, 18 of the slurry transport pathways 12 in a flattened out view, meant to show flow paths. In an actual application, the slurry transport pathways 12 extend along the exterior of a screen assembly 20 (FIG. 12). While two slurry transport pathways 12 are shown in FIG. 1, more or less may be used. For example, four transport pathways 12 are illustrated in FIG. 2. Also, the transport pathways 12 may have varying lengths within the gravel pack system 14. The slurry transport pathways 12 include one or more transport tubes 24. The transport tubes 24 may extend substantially parallel to a longitudinal axis 22 of the gravel pack system 14, or alternatively, as shown in FIGS. 11 and 12, the transport tubes 24 may extend helically with respect to the longitudinal axis 22. The helical arrangement of the transport tubes 24 provides screen centralization and aid in the even distribution of the sand/proppant slurry. This in turn reduces the likelihood of annular bridging during slurry placement. The slurry transport pathways 12 may further include a plurality of packing tubes 26 extending from the transport tubes 24. The packing tubes 26 are fluidically connected to the respective transport tubes 24. Each packing tube 26 includes one or more slurry exit ports 28. The slurry exit ports 28 may be sized large enough to provide lower slurry exit velocities which may otherwise diminish casing or borehole erosion. Slurry exit ports 28 may additionally point away, sometimes at a downward angle, from the screen assembly 20 and into annulus 66 between the screen assembly 20 and the borehole 36.

Figure 3:
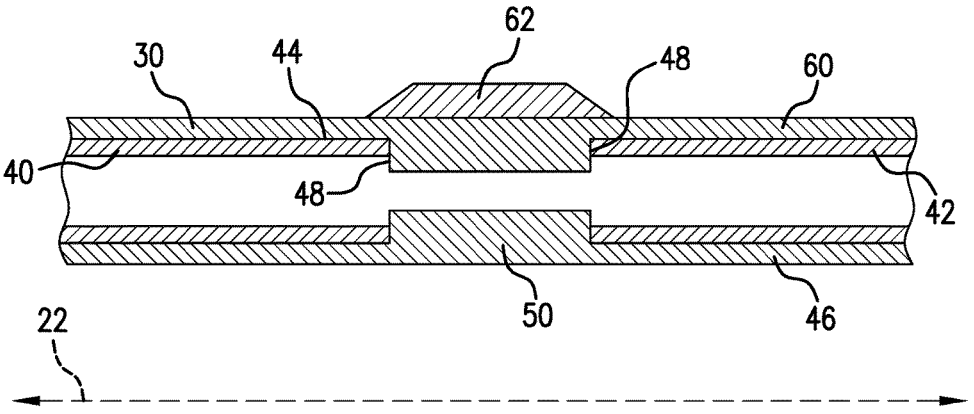
FIG. 3 depicts a sectional view of a portion of one embodiment of a transport coupling and slurry transport tubes for the slurry transport hardware.
Figure 4:
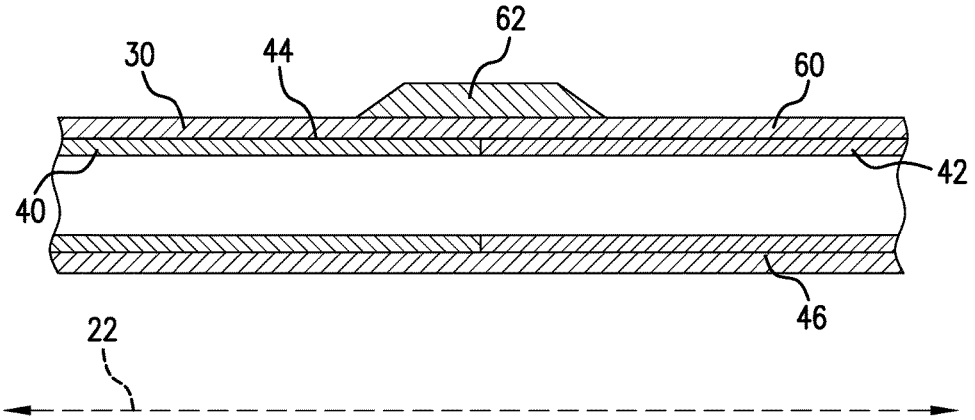
FIG. 4 depicts a sectional view of a portion of another embodiment of a transport coupling and slurry transport tubes for the slurry transport hardware.
Figure 5:
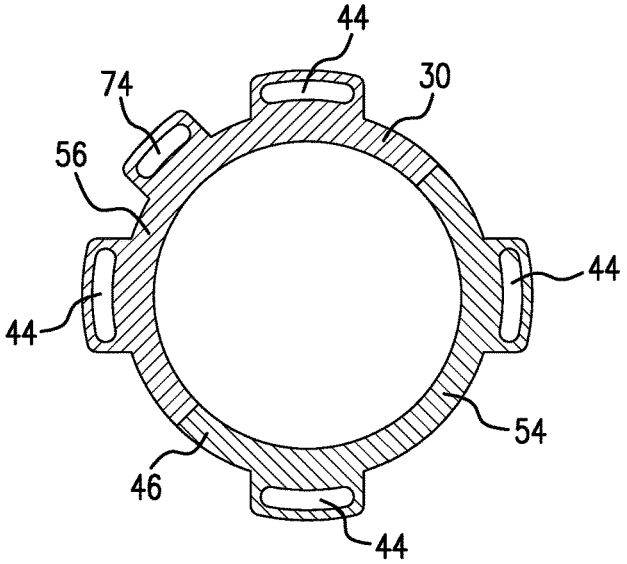
FIG. 5 depicts an end view of one embodiment of the transport coupling.

The slurry transport hardware 10 further includes a transport coupling 30 configured to couple the slurry transport tubes 24 to the radially interiorly arranged screen assembly 20 (FIG. 12). The transport coupling 30 includes a first end 32 and a second end 34 distanced longitudinally from the first end 32. In application, when the gravel pack system 14 is inserted within a borehole 36 (FIG. 13), the first end 32 may be referred to as an uphole end and the second end 34 may be referred to as a downhole end. The slurry transport tubes 24 provide a flow passage for slurry 38 passing through the transport coupling 30. As space is oftentimes limited within boreholes 36, the slurry transport tubes 24 may have a flattened or kidney shaped cross-section as opposed to a circular cross-section, in order to limit the total outer diameter of the gravel pack system 14. The transport coupling 30 may further serve to longitudinally connect a first slurry transport tube 40 to a second slurry transport tube 42. Due to the length of the overall gravel pack system 14, the slurry transport pathways 12 likely require fluidic connections between adjacent slurry transport tubes 24. FIGS. 3 and 4 show two alternate embodiments for fluidically connecting the slurry transport tubes 40, 42 within coupling 30. In FIG. 3, the first slurry transport tube 40 is inserted into the first end 32 of the coupling 30 and into a slurry transport tube passage 44 formed in the wall 46 of the coupling 30, while the second slurry transport tube 42 is inserted adjacent the second end 32 of the coupling 30. Instead of directly abutting, the first and second tubes 40, 42 are spaced from each other by a portion 50 of the slurry transport tube passage 44 integrally formed with the coupling 30 and including shoulders 48 for ends of the first and second tubes 24 to abut. Thus, the slurry transport pathway 12 is provided in part by the first slurry transport tube 40, the portion 50, and the second slurry transport tube 42. In FIG. 4, the first slurry transport tube 40 and the second slurry transport tube 42 are inserted into the first and second ends 30, 32, respectively, of the coupling 30 and into the slurry transport tube passage 44 and may abut each other as shown. The slurry transport tube passages 44 in the coupling 30 are further shown in FIG. 5, with one embodiment including four substantially evenly circumferentially spaced slurry transport tube passages 44. The slurry transport tube passages 44 may take on any size and shape, and may additionally include conduits for control lines, electrical lines, optical fibers, and other downhole tools.

Figure 13:
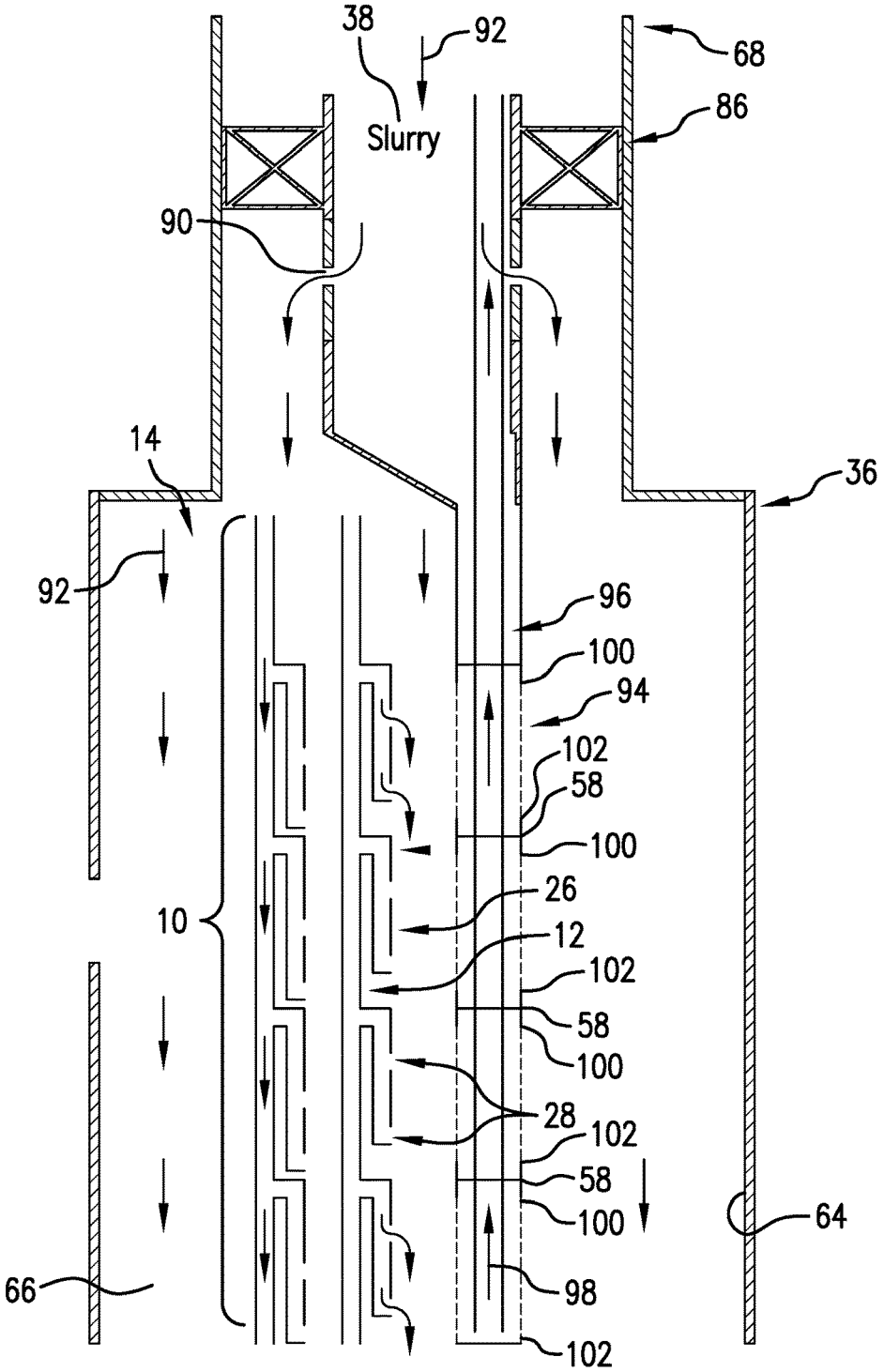

The transport coupling 30 includes a coupling body 52. In one embodiment, such as shown in FIG. 11, the coupling body 52 includes first and second body sections 54, 56 that each extend the longitudinal length of the coupling body 52 from the first end 32 to the second end 34, but only include a section (such as half) of the coupling circumference. The first and second body sections 54, 56 can thus be joined together over the outer periphery of a screen joint connection area 58. The clamshell design of the coupling 30 offers additional centralization and quick makeup minimizing rig time while utilizing standard screen handling/running equipment. An exterior surface 60 of the coupling 30 may further include protrusions 62 extending radially outwardly which serve as centralizer lugs. The protrusions 62, shown in FIGS. 2 and 11, are limited in length and width and help create standoff between the gravel pack system 14 and the formation wall 64 of the borehole 36 (FIG. 13). Maintaining an annular space 66 between the formation wall 64 and the remainder of the exterior surface 60 of the coupler 30 and gravel pack system 14 is important for allowing flow of gravel slurry 38. The protrusions 62 also prevent dragging entire sides of the gravel pack system 14 along the casing 68 or borehole 36 during run-in, thus reducing friction and preventing damage to the walls of the gravel pack system 14 as well as the casing 68 and borehole 36.

Figure 6:
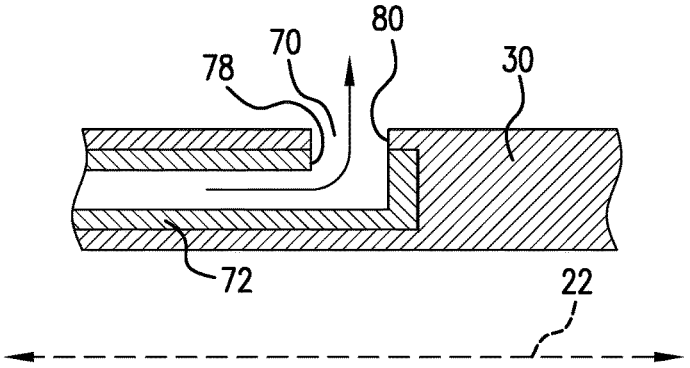
FIG. 6 depicts a sectional view of a portion of one embodiment of a transport coupling and an exit port for the slurry transport hardware.
Figure 7:
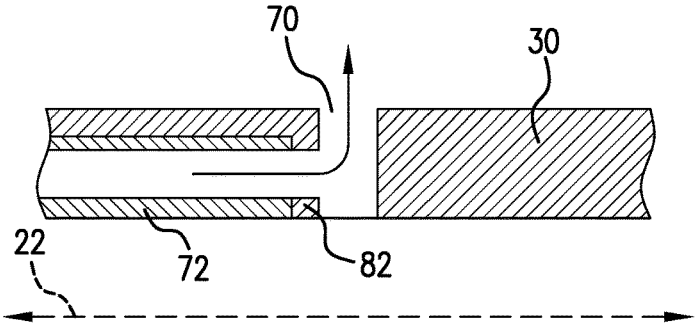
FIG. 7 depicts a sectional view of a portion of another embodiment of a transport coupling and an exit port for the slurry transport hardware.
Figure 8:
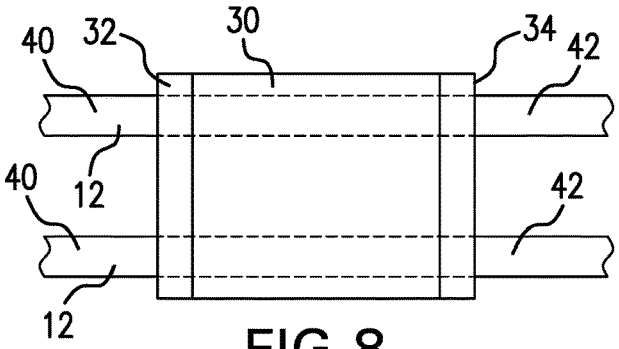
FIG. 8 depicts a schematic view of one embodiment of a portion of slurry transport hardware for a gravel pack system.
Figure 9:
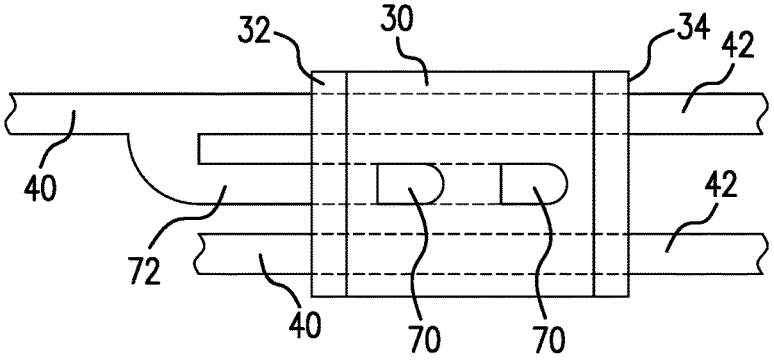
FIG. 9 depicts a schematic view of one embodiment of a portion of slurry transport hardware for a gravel pack system.
Figure 10:
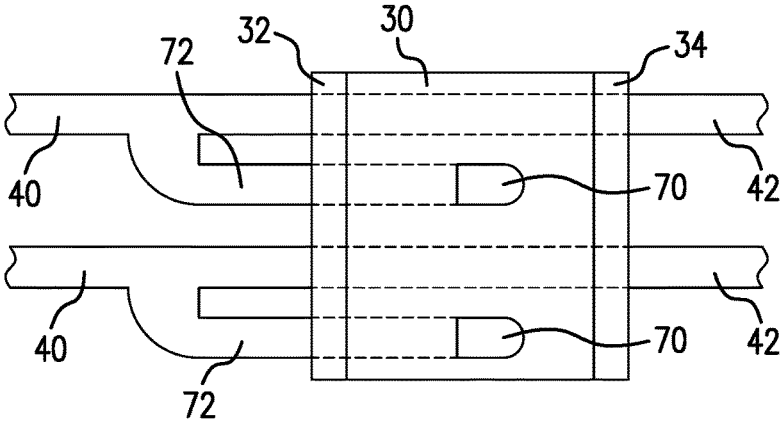
FIG. 10 depicts a schematic view of another embodiment of a portion of slurry transport hardware for a gravel pack system.

Embodiments of the transport coupling 30 further advantageously include at least one slurry exit port 70 in fluidic communication with at least one of the slurry transport pathways 12, in particular with at least one slurry transport tube 40 that passes through the transport coupling 30. The slurry exit port 70 is open to radial exterior surface of coupling 30, and may be substantially centrally located between the first and second ends 32, 34 of the coupling 30. The slurry exit port 70 is associated with a packing tube 72 that additionally passes at least partially into a packing tube passage 74 in the coupling 30. The packing tube 72 and its respective transport tube 40 intersect at an intersection 76. In one embodiment, the intersection 76 is disposed exteriorly of the coupling 30. As shown in FIG. 6, the packing tube 72 may have an opening 78 that aligns with a radially outward facing opening 80 in the wall 46 of the coupling 30 to form the slurry exit port 70 in the coupling 30. Alternatively, as shown in FIG. 7, the packing tube 72 may be stopped at a shoulder 82 adjacent the opening 80 in the coupling 30. In either embodiment, slurry flow 84 is enabled in an area surrounding the transport coupling 30. While a single slurry exit port 70 should be sufficient for gravel packing an area surrounding the transport coupling 30, more than one slurry exit port 70 may be provided. For example, as shown in FIG. 9, more than one slurry exit port 70 may be provided in the transport coupling 30 associated with the same packing tube 72. Alternatively, as shown in FIG. 10, more than one packing tube 72 may be provided within the transport coupling 30, with at least one slurry exit port 70 associated with each packing tube 72. As shown in FIG. 8, one or more of the slurry transport pathways 12 may simply pass through the transport coupling 30 without sharing its slurry flow with a packing tube 72 within the transport coupling 30. In any of the above described embodiments, first transport tubes 40 may be fluidically coupled to second transport tubes 42 as previously described with respect to FIGS. 3 and 4, or by alternate methods of maintaining the slurry flow 84 through the transport pathways 12.

FIG. 13 schematically depicts the gravel pack system 14 secured within the casing 68 by a gravel pack packer 86. A gravel pack extension 88 provides slurry openings 90 for the gravel slurry 38 to pass into the annulus 66 between the gravel pack system 14 and the formation wall 64 of the borehole 36. As the slurry 38 travels in the downhole direction 92, the sand and gravel of the slurry 38 is packed within the annulus 66 while fluid from the slurry 38 passes through screen joints 94 of the screen assembly 20 and into tubular 96, such as an aperture washpipe, or is partially absorbed into the formation. The fluid from the slurry 38 that passes into the tubular 96 (through apertures in the tubular 96) flows in the uphole direction 98 for removal from the borehole 36. While gravel packing, if a bridge occurs in the annulus 66, the bridged area may be bypassed by the slurry transport hardware 10 including the transport tubes 40, 42.

Any kind of screen can be used for the screen joints 94 of the screen assembly 20, and the gravel pack system 14 may further include an outer apertured shroud which can span over the slurry transport hardware 10 as well as the screen assembly 20 for protection of the gravel pack system 14. Each screen joint 94 includes a first end portion 100 and a second end portion 102. The first end portion 100 of one screen joint 94 is securable to a second end portion 102 of an adjacent screen joint 94. The first and second end portions 100, 102 may include threaded connections. For example, the first end portion 100 may include female threads, while the second end portion 102 may include male threads. The first and second end portions 100, 102 do not provide radial fluidic access, unlike screened portions of the screen joints 94. Thus, the length of the connection area 58 between two connected screen joints 94 is not penetrable with liquid into the tubular 96. The slurry transport hardware 10 is connected to the screen assembly 20 at the screen connection area 58 via the transport coupling 30. Thus, the coupling 30 does not additionally block flow into the tubular 96, since there is no radial flow into the tubular 96 at the screen connection area 58. Without the coupling 30 as described in these embodiments, in between screen joints 94, there would be nothing pumping slurry into the area surrounding connection area 58, in an outwardly radial direction. Screen blank sections between adjacent screen joints 94 (Where the screen joints 94 are threaded together) may, in some embodiments, be approximately 8 to approximately 10 feet long. The transport coupling 30 may include a clamshell type assembly as shown in FIG. 11 for securing the coupler 30 to the screen connection area 58. Alternatively, portions of the transport coupling 30 may also be connected to each end portion 100, 102 of the screen assembly 20 such that when the end portions 100, 102 of adjacent screen joints 94 are attached together, the slum/transport tubes 40, 42 are also longitudinally fluidically joined.

When the slurry transport pathways 12 are relied upon for gravel packing, such as when a sand bridge is formed in the annulus 66, the gravel packing in the annulus 66 using the slurry transport pathways 12 avoids a gravel void in the region of the transport tube coupling 30 by employing the slurry exit port 70. The coupling 30 is provided with at least one slurry exit port 70 in fluid communication with the slurry transport pathway 12. In one embodiment, the packing tube 72 includes at least one opening 78, and the coupling 30 includes an opening 80 that is aligned with the opening 78 of the packing tube 72 to form the slurry exit port 70. Alternatively, the coupling 30 may include the opening 80 at the end of the packing tube 72. In yet another alternative embodiment, the packing tube 72 may be integrally formed with coupling 30. In such an embodiment, the transport tube 40 passed into the coupling 30 may include a side port that is alignable with an entrance port of the integrally formed packing tube 72.

In yet another alternate embodiment, both the slurry transport tube and the packing tube may be integrally formed with the coupling 30. In this case, an end of a slurry transport tube 40 need only be connected to the entrance of the integrally formed slurry transport tube. In all of the above-described embodiments, at least some of the slurry 38 passing through the slurry transport tubes 40 will exit the exit port 70 in the coupling 30, located somewhere in the footprint of the coupling 30, to alleviate the occurrence of gravel-packed voids in the area of the coupling 30 that could not be filled by the exit ports 28 uphole and downhole of the coupling 30. In each of the embodiments, there may only be one packing tube 72 for the slurry transport hardware 10 in the area of the coupling 30. That is, in an embodiment where the slurry transport hardware 10 includes four transport pathways 12, only one of the four transport tubes 40 may be connected to a packing tube 72 in the footprint of the coupling 30. Alternatively, the slurry transport hardware 10 may include any number of packing tubes 72 in the footprint of the coupling 30, including one packing tube 72 for some of the transport tubes 40, one packing tube 72 for all of the transport tubes 40, or more than one packing tube 72 for one or more of the transport tubes 40. Thus, the coupling 30 includes at least one slurry exit port 70, but may include a plurality of exit ports 70 fluidically connected to one or more of the transport tubes 40.

Embodiments described herein thus provide a durable sand control screen system/gravel pack system which allows sand/proppant slurry to be transported directly to areas void of slurry despite possible restrictions to flow in the annulus between the screen and casing/borehole during the gravel pack/frac operation, and additionally prevent any voids from developing around the coupling. Despite screen openings not being available in the area of the coupling, the coupling disclosed herein ensures gravel packing even in the coupling area.

Set forth below are some embodiments of the foregoing disclosure:

Embodiment 1

A gravel pack system including: slurry transport hardware including: a first slurry transport pathway; a coupling configured to couple the first slurry transport pathway to a radially interiorly arranged screen assembly; and, a first exit port in the coupler, the first exit port fluidically connected to the first slurry transport pathway, and the first exit port arranged to re-direct at least a portion of slurry passing longitudinally through the first slurry transport pathway in a radially outward direction.

Embodiment 2

The gravel pack system of any of the preceding embodiments, wherein the first slurry transport pathway includes a first slurry transport tube and a first packing tube fluidically connecting the first exit port to the first slurry transport tube.

Embodiment 3

The gravel pack system of any of the preceding embodiments, wherein the coupling includes a coupling body having a first end and a second end, and the first packing tube and the first slurry transport tube fluidically intersect at an intersection, and the intersection is exterior of the connector body.

Embodiment 4

The gravel pack system of any of the preceding embodiments, wherein at least a portion of the first packing tube is integrally formed within the coupling.

Embodiment 5

The gravel pack system of any of the preceding embodiments, further including a plurality of exit ports, the first packing tube fluidically connecting the plurality of exit ports to the first slurry transport tube.

Embodiment 6

The gravel pack system of any of the preceding embodiments, wherein the coupling includes a coupling body, the first exit port disposed between first and second ends of the coupling body, the first slurry transport tube including a portion extending longitudinally exteriorly of the first end of the coupling body and a portion extending within the coupling body.

Embodiment 7

The gravel pack system of any of the preceding embodiments, further including a second slurry transport tube, wherein a portion of the second slurry transport tube extends longitudinally exteriorly from the second end of the connector body and a portion extending within the coupling body.

Embodiment 8

The gravel pack system of any of the preceding embodiments, wherein the first slurry transport tube is longitudinally fluidically connected to the second slurry transport tube within the coupling body.

Embodiment 9

The gravel pack system of any of the preceding embodiments, further including a second slurry transport pathway, the second slurry transport pathway passing through the coupling without a fluidic connection to an exit port in the coupling.

Embodiment 10

The gravel pack system of any of the preceding embodiments, further including a second slurry transport pathway including a second slurry transport tube, a second exit port in the coupling, the second exit port fluidically connected to the second slurry transport tube, and the second exit port arranged to re-direct at least a portion of slurry passing longitudinally through the second slurry transport tube in a radially outward direction.

Embodiment 11

The gravel pack system of any of the preceding embodiments, further including a plurality of exit ports in the coupling, the plurality of exit ports fluidically connected to the first slurry transport pathway.

Embodiment 12

The gravel pack system of any of the preceding embodiments, further including the screen assembly, the screen assembly including a first screen joint having a first screened area permitting fluid to pass in a radial direction, and a second screen joint having a second screened area permitting fluid to pass in a radial direction, the first and second screen joints connected together at a connection area, and the coupling configured to couple the first slurry transport pathway to the exterior of the screen assembly at the connection area.

Embodiment 13

The gravel pack system of any of the preceding embodiments, wherein the first slurry transport pathway includes a first slurry transport tube arranged adjacent at least a portion of a first screen joint and a second slurry transport tube arranged adjacent at least a portion of the second screen joint.

Embodiment 14

The gravel pack system of any of the preceding embodiments, further including a first packing tube fluidically connecting the first slurry transport tube to the first exit port, wherein the first and second slurry transport tubes are longitudinally fluidically connected within the coupling.

Embodiment 15

The gravel pack system of any of the preceding embodiments, further including a tubular disposed radially interiorly of the screen assembly.

Embodiment 16

A method of gravel packing an annulus between a gravel pack system and an outer tubular, the method including: coupling a slurry transport tube of the gravel pack system to a connection area of a screen assembly with a coupling, the connection area including a connection between adjacent screen joints, the coupling including at least one exit port fluidically connected to the slurry transport tube; and, directing slurry into the annulus when a bridge is not formed in the annulus, and, if slurry passage is blocked by a sand bridge, bypassing the sand bridge using the slurry transport tube; wherein at least a portion of the slurry flowing longitudinally through the slurry transport tube is radially directed into the annulus through the at least one exit port in the coupling.

Embodiment 17

The method of any of the preceding embodiments, wherein the outer tubular is an open borehole.

Embodiment 18

The method of any of the preceding embodiments, further including redirecting the at least a portion of the slurry to the at least one exit port using a packing tube fluidically connecting the slurry transport tube to the at least one exit port.

Embodiment 19

The method of any of the preceding embodiments, wherein at least a portion of the slurry flowing longitudinally through the slurry transport tube bypasses the at least one exit port and continues in a longitudinal direction past the coupling.

Embodiment 20

The method of any of the preceding embodiments, wherein coupling the slurry transport tube of the gravel pack system to the connection area of the screen assembly includes longitudinally and fluidically connecting a first slurry transport tube to a second slurry transport tube within the coupling.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A gravel pack system comprising:

slurry transport hardware including:

a first slurry transport pathway including a first slurry transport tube and a first packing tube;

a coupling configured to couple the first slurry transport pathway to a radially interiorly arranged screen assembly; and, a first exit port in the coupling, the first exit port fluidically connected to the first slurry transport pathway, the first exit port arranged to re-direct at least a portion of slurry passing longitudinally through the first slurry transport pathway in a radially outward direction, and the first packing tube fluidically connecting the first exit port to the first slurry transport tube.

2. The gravel pack system of claim 1, wherein the coupling includes a coupling body having a first end and a second end, and the first packing tube and the first slurry transport tube fluidically intersect at an intersection, and the intersection is exterior of the coupling body.

3. The gravel pack system of claim 1, wherein at least a portion of the first packing tube is integrally formed within the coupling.

4. The gravel pack system of claim 1, further comprising a plurality of exit ports, the first packing tube fluidically connecting the plurality of exit ports to the first slurry transport tube.

5. The gravel pack system of claim 1, wherein the coupling includes a coupling body, the first exit port disposed between first and second ends of the coupling body, the first slurry transport tube including a portion extending longitudinally exteriorly of the first end of the coupling body and a portion extending within the coupling body.

6. The gravel pack system of claim 5, further comprising a second slurry transport tube, wherein a portion of the second slurry transport tube extends longitudinally exteriorly from the second end of the coupling body and a portion extending within the coupling body.

7. The gravel pack system of claim 6, wherein the first slurry transport tube is longitudinally fluidically connected to the second slurry transport tube within the coupling body.

8. The gravel pack system of claim 1, further comprising a second slurry transport pathway including a second slurry transport tube, a second exit port in the coupling, the second exit port fluidically connected to the second slurry transport tube, and the second exit port arranged to re-direct at least a portion of slurry passing longitudinally through the second slurry transport tube in a radially outward direction.

9. The gravel pack system of claim 1, further comprising a plurality of exit ports in the coupling, the plurality of exit ports fluidically connected to the first slurry transport pathway.

10. The gravel pack system of claim 1, further comprising the screen assembly, the screen assembly including a first screen joint having a first screened area permitting fluid to pass in a radial direction, and a second screen joint having a second screened area permitting fluid to pass in a radial direction, the first and second screen joints connected together at a connection area, and the coupling configured to couple the first slurry transport pathway to the exterior of the screen assembly at the connection area.

11. The gravel pack system of claim 10, wherein the first slurry transport tube is arranged adjacent at least a portion of the first screen joint and a second slurry transport tube of the first slurry transport pathway is arranged adjacent at least a portion of the second screen joint.

12. The gravel pack system of claim 11, wherein the first and second slurry transport tubes are longitudinally fluidically connected within the coupling.

13. The gravel pack system of claim 11, further comprising a tubular disposed radially interiorly of the screen assembly.

14. A gravel pack system comprising:

slurry transport hardware including:

a first slurry transport pathway;

a second slurry transport pathway;

a coupling configured to couple the first slurry transport pathway to a radially interiorly arranged screen assembly; and, a first exit port in the coupling, the first exit port fluidically connected to the first slurry transport pathway, the first exit port arranged to re-direct at least a portion of slurry passing longitudinally through the first slurry transport pathway in a radially outward direction, and the second slurry transport pathway passing through the coupling without a fluidic connection to an exit port in the coupling.

15. A method of gravel packing an annulus between a gravel pack system and an outer tubular, the method comprising:

coupling a slurry transport tube of the gravel pack system to a connection area of a screen assembly with a coupling, the connection area including a connection between adjacent screen joints, the coupling including at least one exit port fluidically connected to the slurry transport tube; and, directing slurry into the annulus when a bridge is not formed in the annulus, and, if slurry passage is blocked by a sand bridge, bypassing the sand bridge using the slurry transport tube;

wherein at least a portion of the slurry flowing longitudinally through the slurry transport tube is radially directed into the annulus through the at least one exit port in the coupling, and redirecting the at least a portion of the slurry to the at least one exit port using a packing tube fluidically connecting the slurry transport tube to the at least one exit port.

16. The method of claim 15, wherein the outer tubular is an open borehole.

17. The method of claim 15, wherein at least a portion of the slurry flowing longitudinally through the slurry transport tube bypasses the at least one exit port and continues in a longitudinal direction past the coupling.

18. A method of gravel packing an annulus between a gravel pack system and an outer tubular, the method comprising:

coupling a slurry transport tube of the gravel pack system to a connection area of a screen assembly with a coupling, the connection area including a connection between adjacent screen joints, the coupling including at least one exit port fluidically connected to the slurry transport tube; and, directing slurry into the annulus when a bridge is not formed in the annulus, and, if slurry passage is blocked by a sand bridge, bypassing the sand bridge using the slurry transport tube;

wherein at least a portion of the slurry flowing longitudinally through the slurry transport tube is radially directed into the annulus through the at least one exit port in the coupling, and coupling the slurry transport tube of the gravel pack system to the connection area of the screen assembly includes longitudinally and fluidically connecting a first slurry transport tube to a second slurry transport tube within the coupling.

* * * * *